US009825372B1

(12) United States Patent
Buckley

(10) Patent No.: US 9,825,372 B1
(45) Date of Patent: Nov. 21, 2017

(54) DUAL POLARIZED APERTURE COUPLED RADIATING ELEMENT FOR AESA SYSTEMS

(71) Applicant: Rockwell Collins, Inc., Cedar Rapids, IA (US)

(72) Inventor: Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 172 days.

(21) Appl. No.: 14/463,766

(22) Filed: Aug. 20, 2014

Related U.S. Application Data

(60) Provisional application No. 61/934,381, filed on Jan. 31, 2014.

(51) Int. Cl.
*H01Q 21/00* (2006.01)
*H01Q 21/06* (2006.01)
*H01Q 1/38* (2006.01)

(52) U.S. Cl.
CPC ..... *H01Q 21/062* (2013.01); *H01Q 1/38* (2013.01)

(58) Field of Classification Search
CPC ..... H01Q 21/24; H01Q 1/246; H01Q 5/0072
USPC ..... 343/810, 796, 754
See application file for complete search history.

(56) References Cited

U.S. PATENT DOCUMENTS

2010/0066631 A1* 3/2010 Puzella ..... H01Q 1/02 343/853
2012/0274531 A1* 11/2012 Harper ..... H01Q 9/28 343/798
2013/0063310 A1* 3/2013 Mak ..... H01Q 1/246 343/700 MS

* cited by examiner

*Primary Examiner* — Dameon E Levi
*Assistant Examiner* — Collin Dawkins
(74) *Attorney, Agent, or Firm* — Angel N. Gerdzhikov; Donna P. Suchy; Daniel M. Barbieri

(57) ABSTRACT

An antenna with an FR-4 dielectric material layer includes at least one metallization layer having metallic dipoles organized into two clusters. Each of the two clusters includes metallic dipoles generally elongated along a common axis to produce signals of specific polarization. Each of the two clusters is oriented orthogonal to the other to produce two separate, orthogonally polarized signals. Each of the two clusters is associated with a dedicated stripline feed, positioned and oriented to maximize gain of the radiating element. Power from each stripline planar feed couples to the metallic dipoles through a dedicated aperture in the stripline ground plane.

15 Claims, 9 Drawing Sheets

DUAL POLARIZED APERTURE COUPLED RADIATING ELEMENT FOR AESA SYSTEMS

CROSS-REFERENCE TO RELATED APPLICATIONS AND INCORPORATION BY REFERENCE

The present application claims the benefit under 35 U.S.C. §119(e) of U.S. Provisional Application Ser. No. 61/934,381, filed Jan. 31, 2014, which is incorporated herein by reference in its entirety.

FIELD OF THE INVENTION

The present invention is directed generally toward antennas, and more particularly to electronically scanned antennas.

BACKGROUND

Current planar radiating element technology using high dielectric constant FR-4 materials cannot provide a radiating element with relatively wide frequency band and scan volume and good polarization performance. Conventional aperture coupled patch antennas have gain and polarization limitations. Electronically scanned antenna systems often employ a circularly polarized field. Linear polarization imposes inherent limitations on Active Electronically Scanned Antenna (AESA) systems. A circularly polarized radiating element with relatively wide frequency band and scan volume comprised of FR-4 material, would be preferable, if it could be achieved in a single unit cell.

Electronically scanned antennas generally include a manifold layer for distributing power to a feed layer. The feed layer feeds power to a patch layer that transitions the power to free space. The patch layer, for a conventional aperture coupled patch antenna, typically requires low dielectric constant materials that are unsuitable for FR-4 manufacturing processes. Further, the patch layer is substantially thicker than the manifold or feed layers, creating an unbalanced printed circuit board.

Aperture coupled patch antennas generally have a low dielectric constant substrate and two printed circuit board patches. Patches tend to scatter into lower order Floquet modes. In order for the patch to operate effectively, the lower order Floquet modes must be relatively constant over scan and frequency necessitating a small unit cell size and a low dielectric constant polytetrafluoroethylene (PTFE) based substrate. The small unit cell size means that the module density is high, significantly increasing the cost of the antenna and the thermal cooling requirements of the antenna. The use of low dielectric constant PTFE based material also significantly increases the cost of the antenna. Further, scan performance in the H plane scan is poor. Current planar radiating element technology cannot provide a low cost relatively broadband (~30%) aperture coupled dual polarized radiating element comprised exclusively of FR-4 materials, manufactured using standard printed circuit board (PCB) processes, and with a built in radome. Furthermore, the PTFE based aperture layers are substantially thicker than the manifold or feed layers creating an unbalanced printed circuit board.

Consequently, it would be advantageous if an apparatus existed that is a balanced FR-4 printed circuit board, and suitable for use as an aperture coupled dual polarized radiating element with moderately wide frequency bandwidth and scan volume.

SUMMARY

Accordingly, embodiments of the present invention are directed to a novel apparatus that is a balanced FR-4 printed circuit board and suitable for use as an aperture coupled dual polarized radiating element with moderately wide frequency bandwidth and scan volume.

In one aspect, embodiments of the present invention are directed to a radiating element including two linearly polarized feeds, each associated with a plurality of metal elements in a metal layer. An antenna including apertures as described herein produces two polarized signals, 90° out of phase, per-unit-cell.

In a further aspect, embodiments of the present invention are directed to a radiating element configured for dual polarization that utilizes higher order dielectric constant materials. In preferred embodiments, an antenna according to the present invention is implemented as a balanced printed circuit board manufactured using standard FR-4 manufacturing processes.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to the subject matter disclosed herein, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
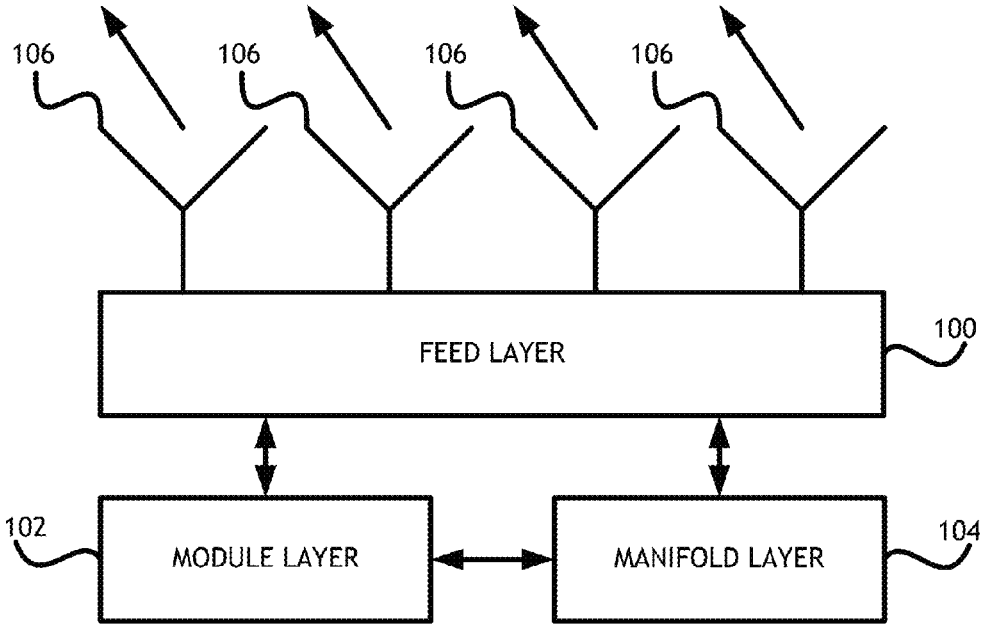
FIG. 1 shows a block diagram of an antenna system according to embodiments of the present invention.

Referring to FIG. 1, an antenna system according to embodiments of the present invention includes a feed layer 100, a manifold layer 104 connected to the feed layer 100, a module layer 102 connected to the feed layer 100 and the manifold layer 104, and an array of radiating element unit cells 106 connected to the feed layer 100. Each radiating element unit cell 106 generates two orthogonally polarized fields. The radiating element unit cells 106 include layers of FR-4 material with printed circuit patterns. The coupling from the radiating element unit cell 106 to the feed layer 100 is through apertures cut in the feed layer's 100 top ground plane.

At least one embodiment of the present invention may include an active electronically scanned antenna. In at least one embodiment, radiating element unit cells 106 in the antenna include two stripline fed apertures. Two orthogonally oriented stripline fed apertures allow for dual polarized excitation of dipole elements in a metal layer of the radiating element. The feed layer 100 and aperture layer may comprise a high dielectric constant material such as FR-4 or similar material. In the context of the present invention, high dielectric constant may be understood to refer generally to a dielectric greater than 3.3. Embodiments of the present invention are directed specifically toward materials with a dielectric constant of between 3.3 and 3.7, though a person of ordinary skill in the art having the benefit of the disclosure may appreciate that other dielectric constants are envisioned. In at least embodiment, the feed layer 100 comprises two 20 mil (0.508 millimeters) FR-4 layers and the aperture layer comprises a 20 mil FR-4 layer, a 20 mil FR-4 layer and another 20 mil FR-4 layer. Such an embodiment scans well over a moderately wide frequency band and offers low cross-polar radiation.

Figure 2:
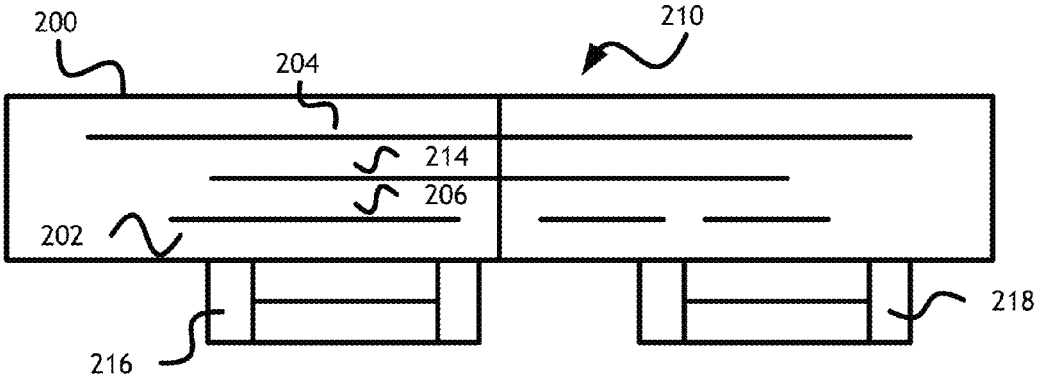
FIG. 2 shows a cross-sectional side view of a radiating element according to embodiments of the present invention with two stripline fed apertures.

Referring to FIG. 2, a radiating element according to embodiments of the present invention with two stripline fed apertures is shown. The radiating element 210 has a number of printed circuit board layers; all printed circuit board layers include a high dielectric material suitable for FR-4 manufacturing processes. The printed circuit board is balanced to reduce warping.

The radiating element 210 may include a built in radome layer 200, an upper metallization layer 204, a mid-metallization layer 214, a lower metallization layer 206, and an aperture feed layer 202 as described more fully herein. Two stripline fed apertures 216, 218 are configured to receive electronic signals from the aperture feed layer 202 and excite the lower metallization layer 206.

In at least one embodiment, a low profile radiating element substrate has a height of 60 mil (1.524 millimeters) (0.074 free space wavelengths at 14.5 GHz). In at least one embodiment, the substrate material is Rogers 4003, having a dielectric constant of 3.55, and loss tangent of 0.0278. In one embodiment, the unit cell size is $0.25\lambda^2$ at 14.5 GHz. Radiating elements according to the present invention may have scan performance of approximately −10 dB return loss out to 30° half conical scan angle for arbitrary phi angle.

In at least one embodiment, the radome layer 200 may include a layer of FR-4 applied at the end of the manufacturing process to protect the underlying metal layers. FR-4 may be applied without "potato-chipping" the board because the underlying printed circuit board is balanced.

Figure 3:
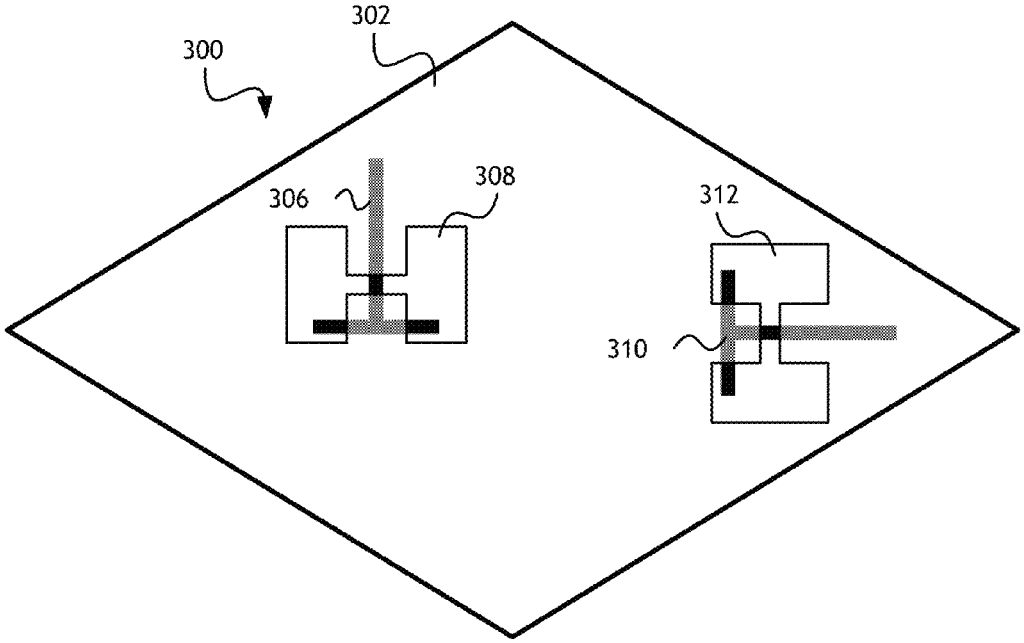
FIG. 3 shows a top view of a ground plane of a radiating element with two apertures to couple the dual polarized signals from the feed layer to the lower metallization layer.

Referring to FIG. 3, a radiating element 300 according to the present invention has a ground plane 302 layer. The ground plane layer 302 defines two apertures openings 308, 312 each corresponding to a stripline 306, 310. In at least one embodiment, a first aperture 308 stripline 306 structure is offset by 90° from a second aperture 312 stripline 310 structure in the ground plane 302. The location and orientation of each apertures opening 308, 312 and corresponding stripline 306, 310 is determined in relation to the gain of the radiating element with respect to the metallic layers and the final geometry of the metallic dipoles of the radiating element as described herein.

Figure 4:
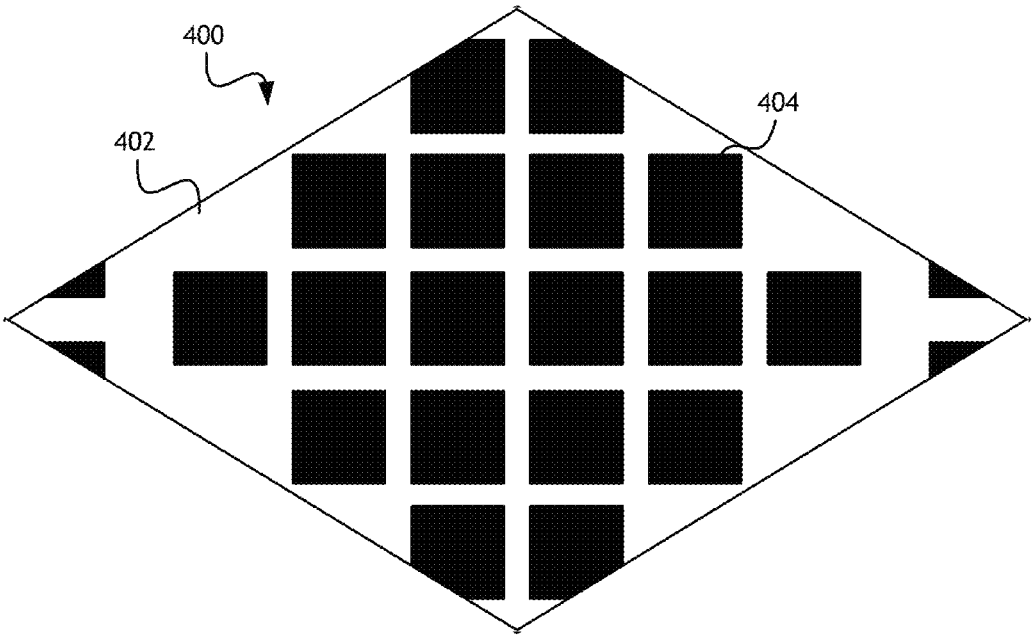
FIG. 4 shows a top view of a lower metallization layer of a radiating element according to embodiments of the present invention.

Referring to FIG. 4, a radiating element 400 according to the present invention may include a lower metallization layer 402. The lower metallization layer 402 includes a plurality of metallic squares 404, organized to tune the radiating element in a particular frequency range and balance additional metal layers as described herein.

Figure 5:
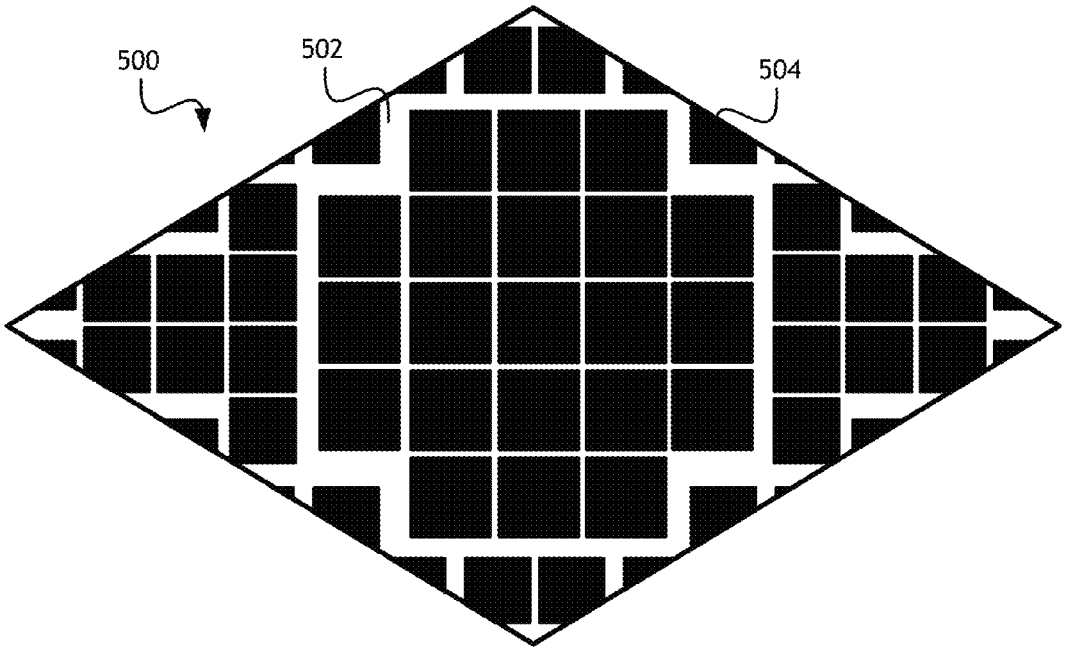
FIG. 5 shows a top view of a mid-metallization layer of a radiating element according to embodiments of the present invention.

Referring to FIG. 5, a radiating element 500 according to the present invention may include a mid-metallization layer 502. The mid-metallization layer 502 includes a plurality of metallic squares 504, organized for wide angle scan. The dipole metallic squares may be excited by signals from a lower metallization layer such as in FIG. 4.

Figure 6:
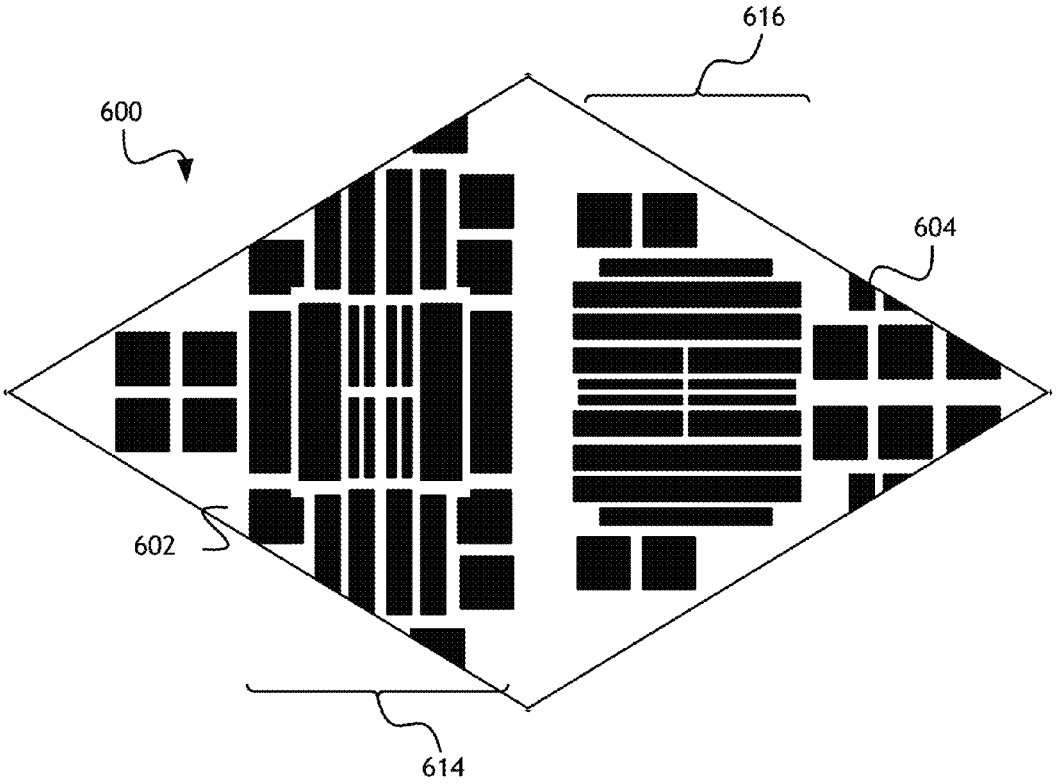
FIG. 6 shows a top view of a upper metallization layer of a radiating element according to embodiments of the present invention.

Referring to FIG. 6, a radiating element 600 according to the present invention may include an upper metallization layer 602. The upper metallization layer 602 includes a plurality of metallic dipole strips 604, organized for wide angle scan. The dipole metallic strips may be excited by signals from a lower metallization layer such as in FIG. 4.

A person skilled in the art having the benefit of the disclosure may appreciate that while the exemplary embodiment described herein is specifically directed toward metallic dipole strips 604 organized into dipole strip clusters 614, 616 in an upper metallization layer 602, metallic dipole strips organized into dipole strip clusters in other metallization layers may also be effective in producing per-unit-cell dual polarization. Radiating elements according to embodiments of the present invention may produce a per-unit-cell dual polarized signal suitable for active electronically scanned array systems.

Figure 7:
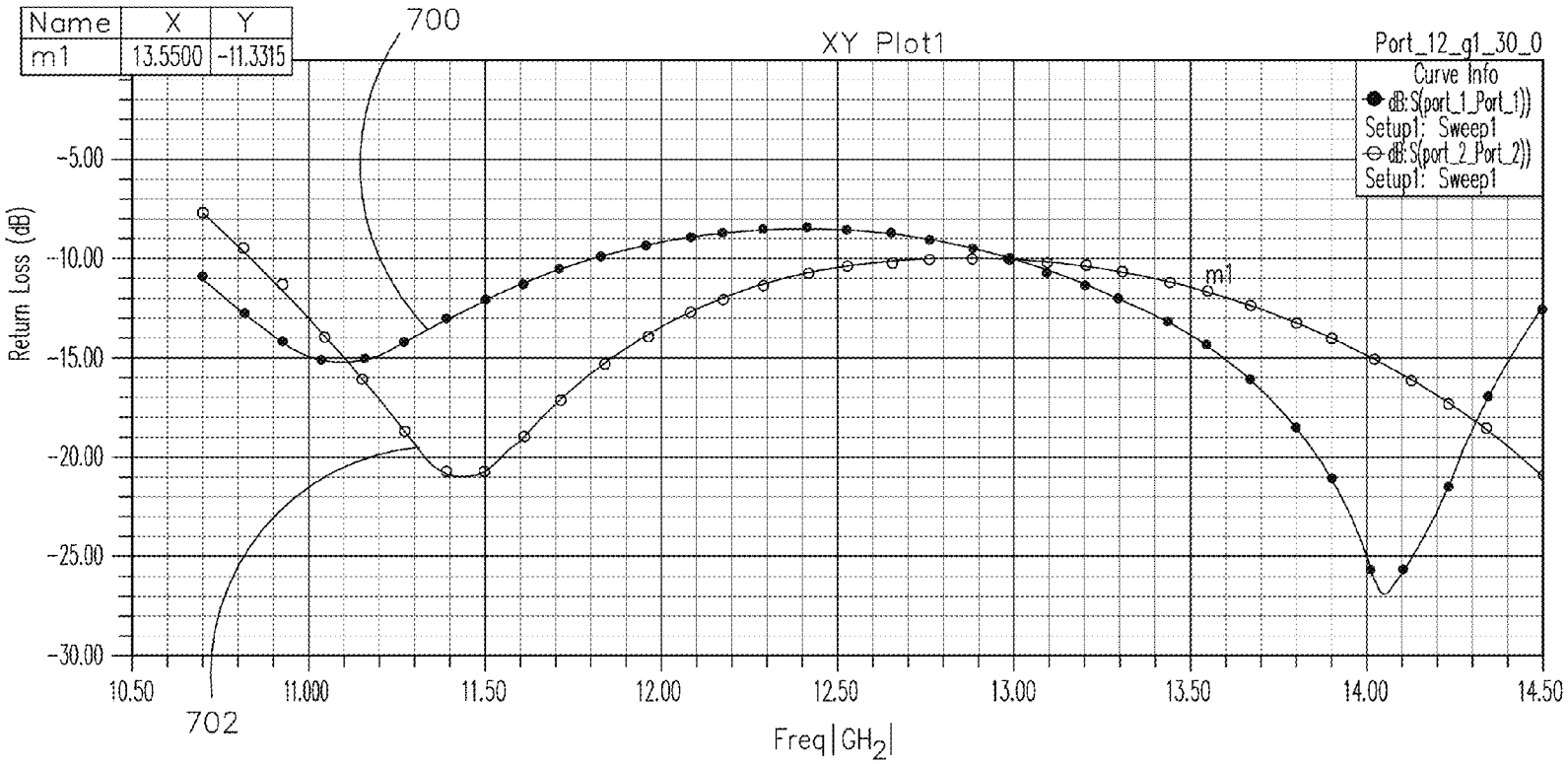
FIG. 7 shows a graphical representation of the performance of a radiating element according to at least one embodiment of the present invention.

Referring to FIG. 7, in at least one exemplary embodiment of the present invention, the performance of a radiating element operating with θ (theta) of 30 degrees and ϕ (phi) of 0 degrees is shown in a frequency range of 10.7 to 14.5 GHz. Performance is measured as return loss in decibels. Return loss is shown for a horizontal polarization 700 and a vertical polarization 702.

Figure 8:
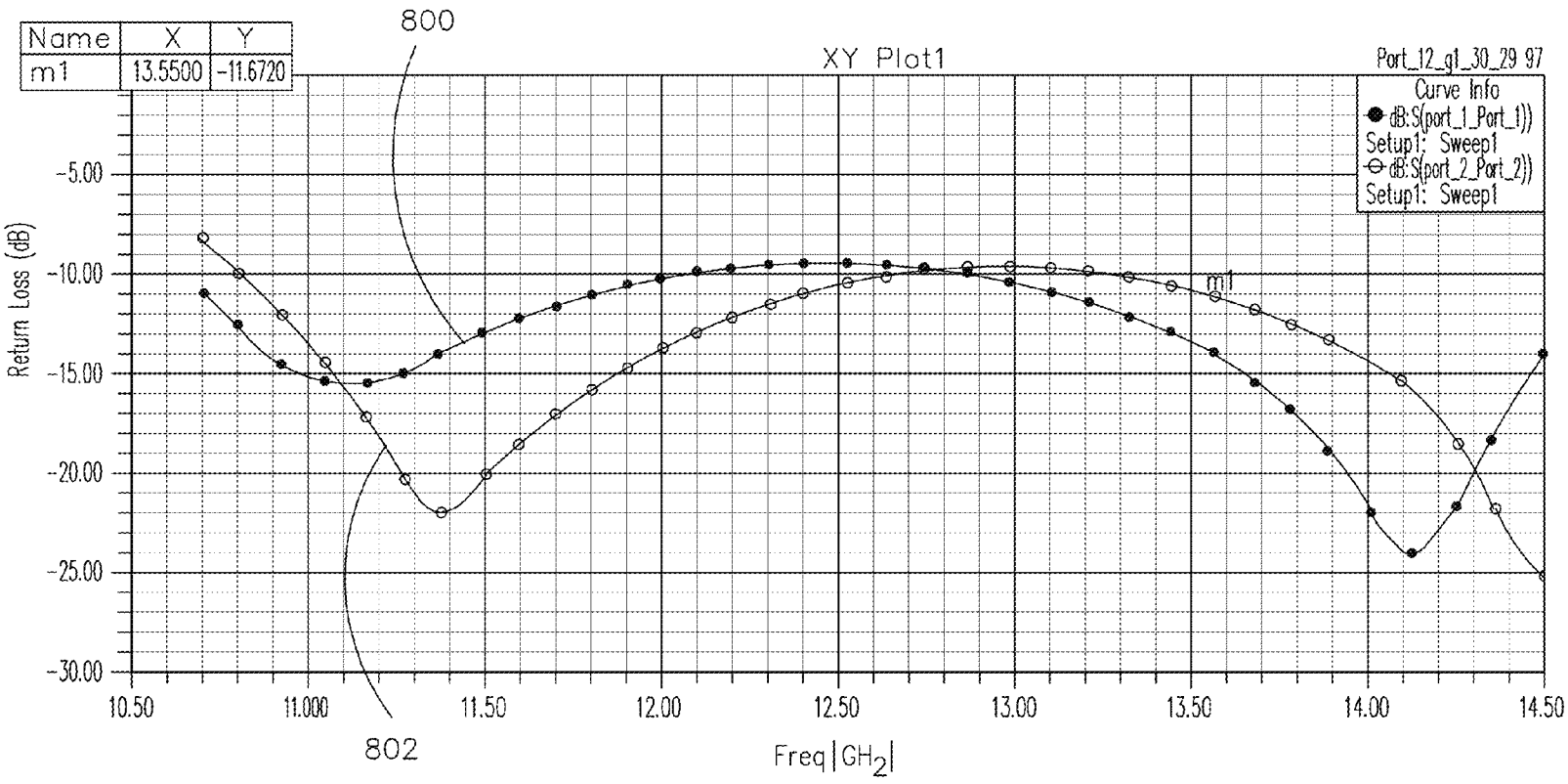
FIG. 8 shows a graphical representation of the performance of a radiating element according to at least one embodiment of the present invention.

Referring to FIG. 8, in at least one exemplary embodiment of the present invention, the performance of a radiating element operating with θ (theta) of 30 degrees and ϕ (phi) of 29.97 degrees is shown in a frequency range of 10.7 to 14.5 GHz. Performance is measured as return loss in decibels. Return loss is shown for a horizontal polarization 800 and a vertical polarization 802.

Figure 9:
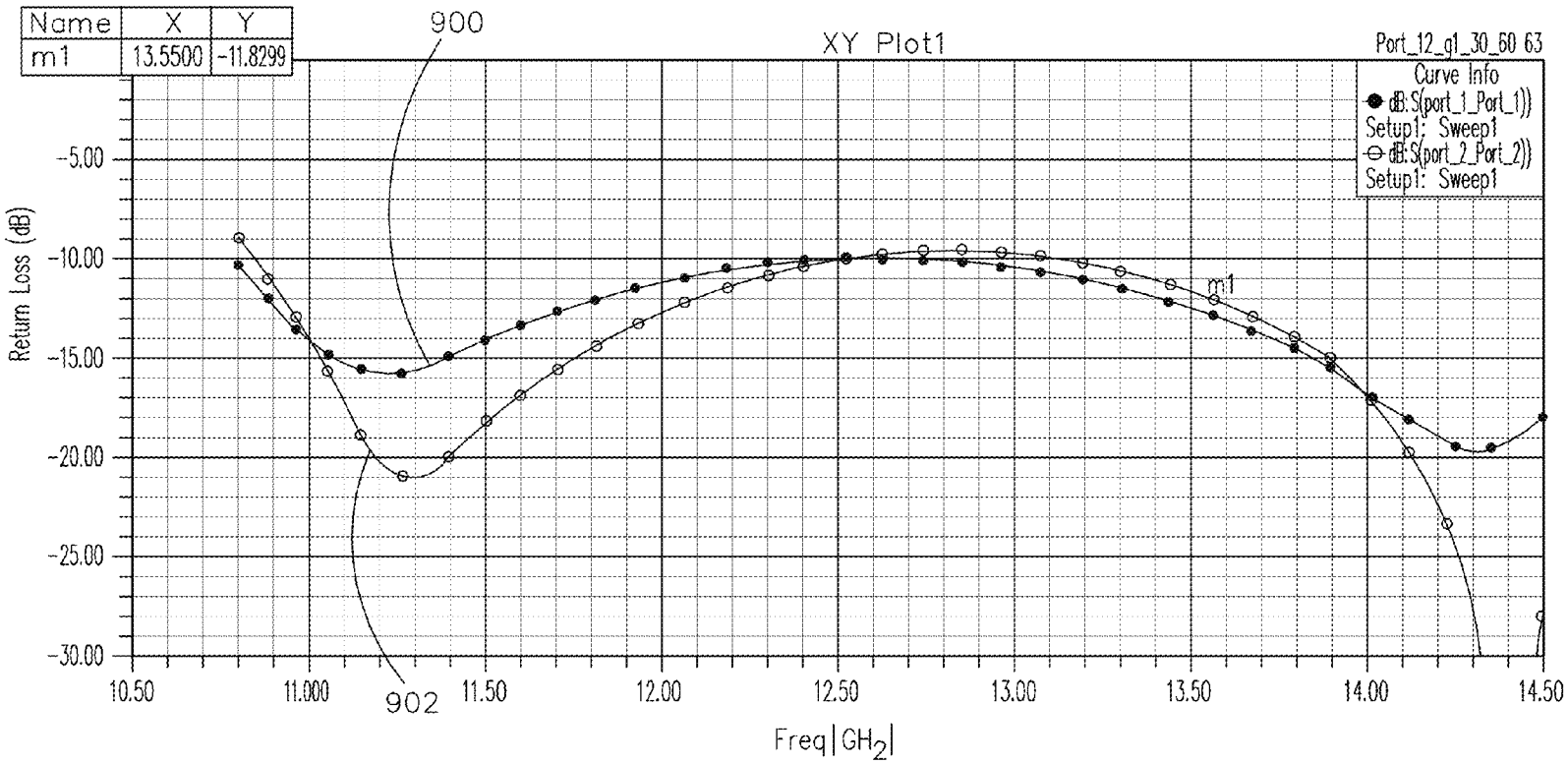
FIG. 9 shows a graphical representation of the performance of a radiating element according to at least one embodiment of the present invention.

Referring to FIG. 9, in at least one exemplary embodiment of the present invention, the performance of a radiating element operating with θ (theta) of 30 degrees and ϕ (phi) of 60.03 degrees is shown in a frequency range of 10.7 to 14.5 GHz. Performance is measured as return loss in decibels. Return loss is shown for a horizontal polarization 900 and a vertical polarization 902.

Figure 10:
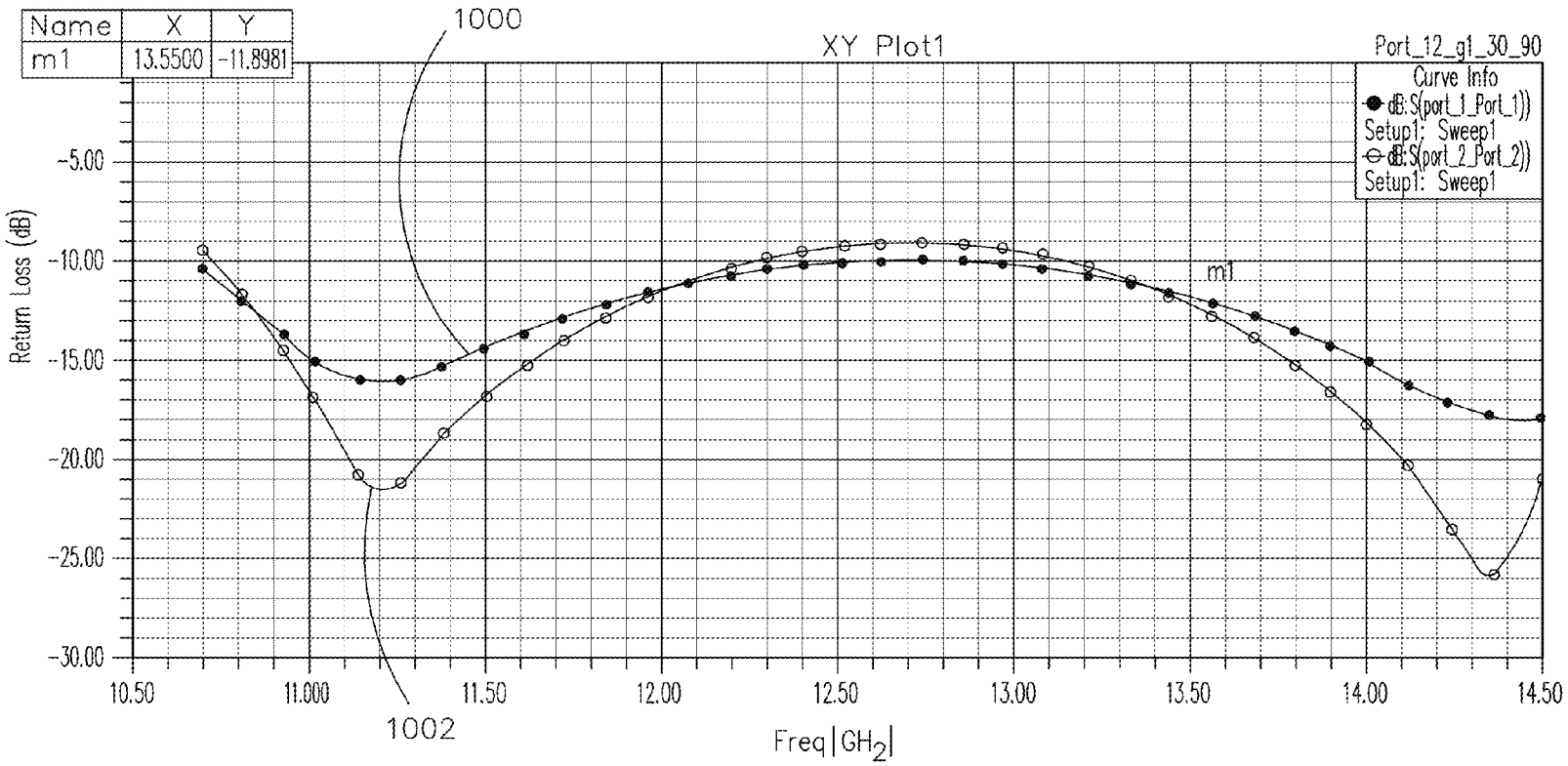
FIG. 10 shows a graphical representation of the performance of a radiating element according to at least one embodiment of the present invention.

Referring to FIG. 10, in at least one exemplary embodiment of the present invention, the performance of a radiating element operating with θ (theta) of 30 degrees and ϕ (phi) of 90 degrees is shown in a frequency range of 10.7 to 14.5 GHz. Performance is measured as return loss in decibels. Return loss is shown for a horizontal polarization 1000 and a vertical polarization 1002.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An electronically scanned array radiating element comprising:

an aperture feed layer;

a ground plane layer;

at least one metallization layer comprising:

a first cluster of metallic dipoles, generally elongated along a first axis, configured to produce a signal having a first polarization; and a second cluster of metallic dipoles, generally elongated along a second axis substantially orthogonal to the first axis, configured to produce a signal having a second polarization substantially orthogonal to the first polarization; and a first stripline fed aperture and a second stripline fed aperture offset from the first stripline fed aperture by 90°, the first stripline fed aperture associated with the first cluster of metallic dipoles and the second stripline fed aperture associated with the second cluster of metallic dipoles, the first stripline fed aperture and the second stripline fed aperture implemented in the ground plane layer, the first stripline fed aperture corresponding to a first stripline, the second stripline fed aperture corresponding to a second stripline, wherein the first stripline fed aperture and the second stripline fed aperture are configured to receive electronic signals from the aperture feed layer, wherein the first cluster and second cluster are segregated within the at least one metallization layer.

2. The radiating element of claim 1, wherein the radiating element is configured to operate in the Ku and X band.

3. The radiating element of claim 1, wherein the radiating element is configured to operate in a frequency range of 10.7 to 14.5 GHz with scan angle θ of 30° and over all ϕ scan angles, $0 \leq \phi \leq 360$ degrees.

4. The radiating element of claim 1, wherein the at least one metallization layer comprises a dielectric constant of between 3.3 and 3.7.

5. The radiating element of claim 1, further comprising an upper metallization layer including a plurality of metallic dipoles organized with substantial bilateral symmetry along both the first axis and the second axis.

6. The radiating element of claim 1, further compromising a lower metallization layer, wherein the lower metallization layer comprises a plurality of metallic squares organized to tune the radiating element in a particular frequency range.

7. An AESA system comprising:

an electronically scanned array radiating element comprising:

an aperture feed layer;

a ground plane layer;

at least one dielectric layer comprising:

a first cluster of metallic dipoles, generally elongated along a first axis, configured to produce a signal having a first polarization; and a second cluster of metallic dipoles, generally elongated along a second axis substantially orthogonal to the first axis, configured to produce a signal having a second polarization substantially orthogonal to the first polarization; and a first stripline fed aperture and a second stripline fed aperture offset from the first stripline fed aperture by 90°, the first stripline fed aperture associated with the first cluster of metallic dipoles and the second stripline fed aperture associated with the second cluster of metallic dipoles, the first stripline fed aperture and the second stripline fed aperture implemented in the ground plane layer, the first stripline fed aperture corresponding to a first stripline, the second stripline fed aperture corresponding to a second stripline, wherein the first stripline fed aperture and the second stripline fed aperture are configured to receive electronic signals from the aperture feed layer, wherein the first cluster and second cluster are segregated within the at least one dielectric layer.

8. The AESA system of claim 7, wherein the electronically scanned array radiating element further comprises a radome layer.

9. The AESA system of claim 8, wherein the radome layer comprises a layer of FR-4.

10. The AESA system of claim 7, wherein the electronically scanned array radiating element is configured to operate in the Ku and X band.

11. The AESA system of claim 7, wherein the electronically scanned array radiating element is configured to operate in a frequency range of 10.7 to 14.5 GHz with scan angle θ of 30° and over all ϕ scan angles, $0 \leq \phi \leq 360$ degrees.

12. The AESA system of claim 7, wherein the at least one dielectric layer comprises a dielectric constant of between 3.3 and 3.7.

13. The AESA system of claim 12, further comprising an upper metallization layer including a plurality of metallic dipoles organized with substantial bilateral symmetry along both the first axis and the second axis.

14. The AESA system of claim 13, further comprising a lower metallization layer including a plurality of metallic squares organized to tune the radiating element to a particular frequency range.

15. An antenna comprising:

a plurality of radiating elements, each radiating element comprising:

an aperture feed layer;

a ground plane layer;

at least one metallization layer comprising:

a first cluster of metallic dipoles, generally elongated along a first axis, configured to produce a signal having a first polarization; and a second cluster of metallic dipoles, generally elongated along a second axis substantially orthogonal to the first axis, configured to produce a signal having a second polarization substantially orthogonal to the first polarization; and a first stripline fed aperture and a second stripline fed aperture offset from the first stripline fed aperture by 90°, the first stripline fed aperture associated with the first cluster of metallic dipoles and the second stripline fed aperture associated with the second cluster of metallic dipoles, the first stripline fed aperture and the second stripline fed aperture implemented in the ground plane layer, the first stripline fed aperture corresponding to a first stripline, the second stripline fed aperture corresponding to a second stripline, wherein the first stripline fed aperture and the second stripline fed aperture are configured to receive electronic signals from the aperture feed layer, wherein the first cluster and second cluster are segregated within the at least one metallization layer.

* * * * *